US011883759B1

(12) United States Patent
Sutton, Jr.

(10) Patent No.: US 11,883,759 B1
(45) Date of Patent: Jan. 30, 2024

(54) DEFORMABLE TOY SNAKE OR SNAKE ACCESSORY

(71) Applicant: Robert Lee Sutton, Jr., Miami, FL (US)

(72) Inventor: Robert Lee Sutton, Jr., Miami, FL (US)

( * ) Notice: Subject to any disclaimer, the term of this patent is extended or adjusted under 35 U.S.C. 154(b) by 80 days.

(21) Appl. No.: 17/384,123

(22) Filed: Jul. 23, 2021

Related U.S. Application Data

(60) Provisional application No. 63/056,366, filed on Jul. 24, 2020.

(51) Int. Cl.

| | |
|---|---|
| ***A63H 3/20*** | (2006.01) |
| ***A63H 13/02*** | (2006.01) |
| ***A63H 3/04*** | (2006.01) |
| ***A63H 3/28*** | (2006.01) |

(52) U.S. Cl.
CPC ..... *A63H 3/20* (2013.01); *A63H 3/04* (2013.01); *A63H 13/02* (2013.01); *A63H 3/28* (2013.01)

(58) Field of Classification Search
CPC ... A63H 3/04; A63H 3/14; A63H 3/20; A63H 13/00; A63H 13/005; A63H 13/02
USPC ..... 446/237, 238, 239, 330, 336, 337, 338, 446/339, 340, 368, 327, 328, 329
See application file for complete search history.

(56) References Cited

U.S. PATENT DOCUMENTS

| | | | | |
|---|---|---|---|---|
| 644,121 A | | 2/1900 | Yelle | |
| 725,432 A | | 4/1903 | Flaherty | |
| 1,324,646 A | | 12/1919 | Clements | |
| 1,745,232 A | * | 1/1930 | Richter | A63H 3/04 446/368 |
| 2,035,308 A | | 3/1936 | Ferber | |
| 2,194,537 A | | 3/1940 | Adams | |
| 2,241,576 A | * | 5/1941 | Barton | A63H 7/00 446/361 |
| 2,633,670 A | * | 4/1953 | Steuber | A63H 3/14 446/329 |
| 3,005,283 A | * | 10/1961 | Cohn | A63H 3/24 446/305 |
| 3,186,126 A | * | 6/1965 | Ostrander | A63H 3/48 446/190 |
| 3,195,269 A | * | 7/1965 | Weih | A63H 3/48 446/340 |
| 3,210,887 A | * | 10/1965 | Glass | A63H 3/48 446/190 |

(Continued)

FOREIGN PATENT DOCUMENTS

| | | |
|---|---|---|
| CN | 88205699 | 11/1988 |
| CN | 2030892 | 1/1989 |

*Primary Examiner* — Joseph B Baldori
(74) *Attorney, Agent, or Firm* — John Rizvi; John Rizvi, P.A.—The Patent Professor®

(57) ABSTRACT

A formable, deformable or shapeable toy snake or snake accessory is provided. The toy, snake can include one or more head weights, such as a plurality of weighted head beads. The body of the toy snake is deformable and is made of bendable material that may have elastic or springing properties. The tail of the toy snake can include a plurality of tail beads. At least some of the head weights may push the head forward when a user swings a central section of the snake with forward and then rearward acceleration. The head weight or weights cause a mouth of the toy snake to open as a weight of the head weight or weights pushes the head of the snake forward.

17 Claims, 8 Drawing Sheets

(56) References Cited

U.S. PATENT DOCUMENTS 4,236,711 A * 12/1980 Klingbeil ..... A63J 21/00 446/72
4,244,138 A * 1/1981 Holahan ..... A63H 13/02 446/365
4,244,139 A * 1/1981 Erickson ..... A63H 3/20 446/304
4,457,097 A * 7/1984 Miller ..... A63H 3/48 446/334
4,553,946 A * 11/1985 Miller ..... A63H 3/14 446/334
4,695,265 A * 9/1987 Clark ..... A63H 3/18 446/329
4,925,425 A * 5/1990 Ohta ..... A63H 3/28 446/340
5,145,445 A * 9/1992 Northey ..... A63H 3/14 446/329
5,385,500 A 1/1995 Schmidt
5,569,131 A 10/1996 Giulianelli
5,628,667 A 5/1997 Levi
6,110,001 A * 8/2000 Chae ..... A63H 3/31 446/183
6,431,941 B1 * 8/2002 Frawley ..... A63H 3/20 446/337
6,461,218 B1 10/2002 Mullaney et al.
7,029,361 B2 4/2006 Seibert et al.
7,422,506 B2 * 9/2008 Lund ..... A63H 13/12 446/353
7,517,271 B1 * 4/2009 Alfaro ..... A63J 7/00 446/361
7,635,288 B2 * 12/2009 Kawata ..... A63H 3/14 446/330
7,722,430 B2 5/2010 Hippely
D624,974 S 10/2010 Taylor
8,641,472 B2 2/2014 Taylor
9,463,393 B2 10/2016 Olivera et al.
9,814,216 B2 11/2017 Byrne et al.
D815,369 S 4/2018 Byrne et al.
11,590,429 B2 * 2/2023 Lovik ..... A63H 3/14
2002/0118535 A1 8/2002 Nostrant
2004/0077275 A1 * 4/2004 Burbank ..... A63H 3/14 446/321
2006/0183402 A1 * 8/2006 von Jabba ..... A63H 3/20 446/359
2007/0026763 A1 2/2007 Panec et al.
2007/0218799 A1 9/2007 Tobin
2011/0287690 A1 11/2011 Taylor
2016/0310856 A1 10/2016 Mitchell et al.
2018/0311590 A1 11/2018 Rasmussen
2021/0031119 A1 * 2/2021 Clements ..... A63J 7/005

* cited by examiner

DEFORMABLE TOY SNAKE OR SNAKE ACCESSORY

CROSS-REFERENCE TO RELATED APPLICATION

This application claims the benefit of United States Provisional Patent Application No, 63/056,366, filed on Jul. 24, 2020, which is incorporated herein by reference in its entirety.

FIELD OF THE INVENTION

The present invention relates generally to toy snakes, and more particularly to a formable, deformable or shapeable toy snake or snake accessory adapted to rattle and exhibit a striking motion with its mouth when shaken and thrusted forward by its user.

BACKGROUND OF THE INVENTION

Toy snakes can be used by one or more persons to imitate the behavior and movements of real snakes. For example, like real snakes, toy snakes can be placed on people such as on their arms, shoulders, and neck. Users of the toy snakes may attempt to use the toy snakes to make various sounds and movements that can be made by real-life snakes. Further, one or more persons and users may want to play with toy snakes as with an actual snake, and get the toy snakes to be able to perform the same body motions and also imitate the same behaviors that an actual snake would make when if the snake were to open its mouth from being shaken or thrusted forward.

Currently, toy snakes may not have the actual internal structure or mechanical features to imitate the motions and the behaviors of actual snakes. The internal structure may include mechanical actuation features within the body of the toy snake. Such actuation features may not be present within the toy snakes at this time that can allow the toy snakes to perform the motions and behaviors of actual snakes. Such motions may include rattling or slithering forward, while such behaviors could include the head of the toy snake thrusting forward and opening its mouth to show its tongue and fangs. Another behavior may include the toy snake making a sudden movement or motion with its mouth. If a user were to wrap a toy snake around his/her arm, and try to shake or thrust the toy snake forward, the toy snake may not have the actuation features which can enable the toy snake to perform the physical movements with its body that an actual snake would perform if it were squeezed or thrusted forward. More specifically, the toy snake may not rattle forward or perform any motions with its head or mouth that an actual snake could perform. In addition, users may have to perform the motions on the toy snakes such as opening the toy snake's mouth or moving the body of the toy snake in a manner similar to how an actual snake could move.

When the user manually attempts to move the toy snake, the user may not be able to get the toy snake to be able to imitate the motions that an actual snake may make with its mouth such as when the actual snake thrusts forward. Further, the user may have to place more effort when trying to get the toy snake to perform more authentic movements that are similar to actual snakes. The user may have to use his or her hands or other external mechanisms to enable the toy snake to perform the movements which actual snakes perform, such as getting the snake to slither/move forward or make a hissing sound with its mouth. Accordingly, it can be cumbersome for the user to try to have to manipulate the toy snake to imitate the movements and behaviors of actual snakes.

Ideally, it would be extremely useful for toy snakes to have internal structure which can allow it to move more like actual snakes. Moreover, it would be useful for the internal structure to include actuation features to be present within toy snakes to minimize the amount of work that its user would have to do to imitate the movement and behavior of actual snakes. Toy, snakes that have specific internal actuation features may allow users to not have to provide many of the motions onto the toy snakes to imitate actual movements of real snakes.

Accordingly, there is need for a solution to at least one of the aforementioned problems. For instance, there is an established need for preferably a toy snake to have one or more internal actuation features which can allow the toy snake to perform movements similar to that of an actual snake with less involvement by the user to provide movements to the toy snake. In addition, the internal actuation features should be able to be used by persons using the toy snake to perform the desired movements and behaviors which imitate the movements of real-life snakes.

SUMMARY OF THE INVENTION

The present invention is directed to a formable, deformable or shapeable toy snake or snake accessory that can be wrapped around the arms, head, neck and/or shoulder regions of a user, and imitate the motions and behavior of an actual snake. The toy snake may be configured with one or more mechanical actuation features within its body. The mechanical actuation features can include but is not limited to, an articulated structure within the body. The toy snake may also include one or more weights within the head, a movable tongue, spring-biased mouth, and moving fangs which can be found within the mouth. The mechanical actuation features can allow the body of the snake to have a springing and bouncing ability. The snake can thrust forward and also retract after being thrust forward by a person wearing or operating the snake. The person wearing the snake can also shake the snake in one or more directions, and also squeeze the snake in one or more areas. Accordingly, in an exemplary application, a person can wear the toy snake on his arm, neck and shoulder and thrust the toy snake or shake the toy snake to enable the mechanical actuation features such as the tongue and fangs to be move forward and be shown as the mouth is in an open position. In another exemplary application, a person can squeeze the snake in an area such as the belly and enable the toy snake to thrust forward.

In a first implementation of the invention, a formable, deformable or shapeable toy snake or snake accessory may include a head and a deformable body connected to the head. The head may include a top portion and a bottom portion, wherein the top and bottom portions may define a mouth and may be movable relative to one another to adjust the mouth between an open position and a closed position. The body may include a front section carrying the head and a central section extending rearward form the front section. The deformable body is movable to the open position by applying subsequent forward and rearward forces on the central section of the body, such that the front section of the body and the bottom portion of the head are thrust forward relative to the central section of the body and the top portion of the head is moved away from the central section of the body, and the bottom portion of the head.

In a second aspect, the head may further include one or more weights.

In another aspect, the top portion of the head may include one or more weights.

In another aspect, the one or more weights may be located at a rear area of the top portion of the head.

In another aspect, the mouth may be movable to the closed position by a movement of the front section of the body and the bottom portion of the head towards the central section of the body and a movement of the top portion of the head towards the central section of the body and the bottom portion of the head.

In yet another aspect, the body may be elastically deformable such that the front section of the body is biased to move towards the central section of the body.

In another aspect, the top and bottom portions of the head may be pivotable relative to one another.

In another aspect, the bottom portion of the head may be jointly movable with the front section of the body.

In another aspect, the top and bottom portions of the head may be spring-biased towards one another to adjust the mouth to the closed position.

In yet another aspect, the body may include an internal deformable structure housed inside the central and front sections of the body. The head may include internal, first and second elongate members housed inside the top and bottom portions of the head, respectively. The first and second elongate members may be movably connected to the internal deformable structure.

In another aspect, the deformable structure may be elastically deformable.

In another aspect, the first elongate member may be articulately connected to the deformable structure.

In another aspect, the deformable structure may be articulately connected to the first elongate member by at least one pivotable connection.

In yet another aspect, the second elongate member may be carried by and movable jointly with the deformable structure.

In another aspect, the deformable snake accessory may further comprise at least one fang movably carried by the top portion of the head. The at least one fang may be configured to move from a first position, in which the at least one fang is moved towards the top portion and concealed within the mouth in the closed position, to a second position, in which the at least one fang is moved away from the top portion and visible within the mouth in the open position.

In another aspect, the at least one fang may be movable to the second position upon a movement of the mouth to the open position.

In another aspect, the at least one fang may be spring-biased towards the second position and automatically movable to the second position upon a movement of the mouth to the open position.

In yet another aspect, the deformable snake accessory may further comprise a tongue portion carried by the head and configured to freely oscillate within the mouth when the mouth is arranged in the open position.

In another aspect, the body may include or consist in a spring-biased, articulated body.

In another aspect, the body may be formed of bendable material with elastic or springing properties.

In another aspect, the person can walk in a forward motion as the toy snake is wrapped around his/her arms and hand(s). The forward motion can cause the toy snake to thrust forward and can enable the head beads to exert force onto the tongue. Due to the force of the head beads, the tongue can move forward and enable the mouth to go from a closed position to an open position. As the mouth is in the open position, the tongue and the fangs of the toy snake can be seen. The tongue and the fangs and the mouth can perform motions similar to that of an actual snake as the mouth is open. The mouth can also perform a striking motion. The tongue can also retract back into the mouth given the spring and bouncing abilities of the toy snake as the person is walking forward.

In yet another aspect, the toy snake can be wrapped around the neck and shoulders of the person. The person can shake his neck and shoulders and cause the toy snake to thrust forward. Accordingly, the weighted head beads can exert force on the tongue to move forward as the mouth is originally in the closed position. The tongue can continue to move forward and allow the mouth to be in an open position, wherein the tongue and the fangs of the toy snake are visible. The mouth can also perform a snapping or striking motion when it is open. When the person stops thrusting the snake forward, the springing and bouncing abilities of the toy snake can allow the tongue to retract back within the mouth.

In another aspect, the tail of the toy snake can have weighted tail beads that can also exert force on the body of the toy snake and enable the toy snake to be thrusted forward when the user shakes the tail of the toy snake.

In another aspect, the user can shake the tail of the toy snake, wherein the tail includes weighted tail beads that can exert force on the tail and the body of the toy snake to thrust the toy snake forward.

In another aspect, the body of the snake can comprise an articulated structure formed of bendable material with elastic or springing properties that allow the toy snake to thrust forward and to retract after being thrust forward.

In another aspect, the articulated structure may extend from the body to the mouth of the toy snake.

In another aspect, the person can have the toy snake wrapped around the neck and shoulders and move or walk forward. The forward motion of the user can thrust the toy snake forward given the springing and bouncing features of the toy snake. The weighted head beads can exert force onto the tongue, and the tongue can move forward and enable or force the mouth to open. As a result, the tongue and the fangs of the toy snake can be exposed and thrust forward. The mouth can also perform a striking motion. Further, the springing and bouncing properties of the toy snake can also allow the toy snake to retract after being thrust forward as a result of the person moving forward. Accordingly, the tongue can retract back into the mouth, and the mouth can be once again in the closed position.

In another aspect, the user can shake his neck or shoulders while the toy snake is on his/her neck or shoulders to cause the mouth to open and perform a striking motion.

In another aspect, the person can exert force on the toy snake by squeezing one or more or portions of the body of the toy snake to cause the toy snake to thrust forward and the mouth to be in the open position.

In another aspect, the person can exert force directly on the head, which can cause the head beads to exert a force enabling the mouth to open and perform a striking motion.

In another aspect, the toy snake can thrust forward intermittently as a result of the person moving forward while the snake is on the neck and the shoulders of the person.

In another aspect, the person can shake his neck and shoulders and accordingly thrust the toy snake forward as a result. The tail beads within the tail of the toy snake may exert force on the body of the snake, and enable the body to thrust forward. The head beads within the head of the toy snake can exert force on the tongue and cause the tongue to move forward, and open the mouth. The tongue and the fangs can be visible when the mouth is opened. The mouth can also perform a striking motion. Due to the springing abilities of the toy snake, the tongue can also retract into the mouth, and also come back into the open position.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements; and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a formable, deformable or shapeable toy snake that has mechanical actuation features that allow the toy snake to retract after being thrust forward.

Figure 1:
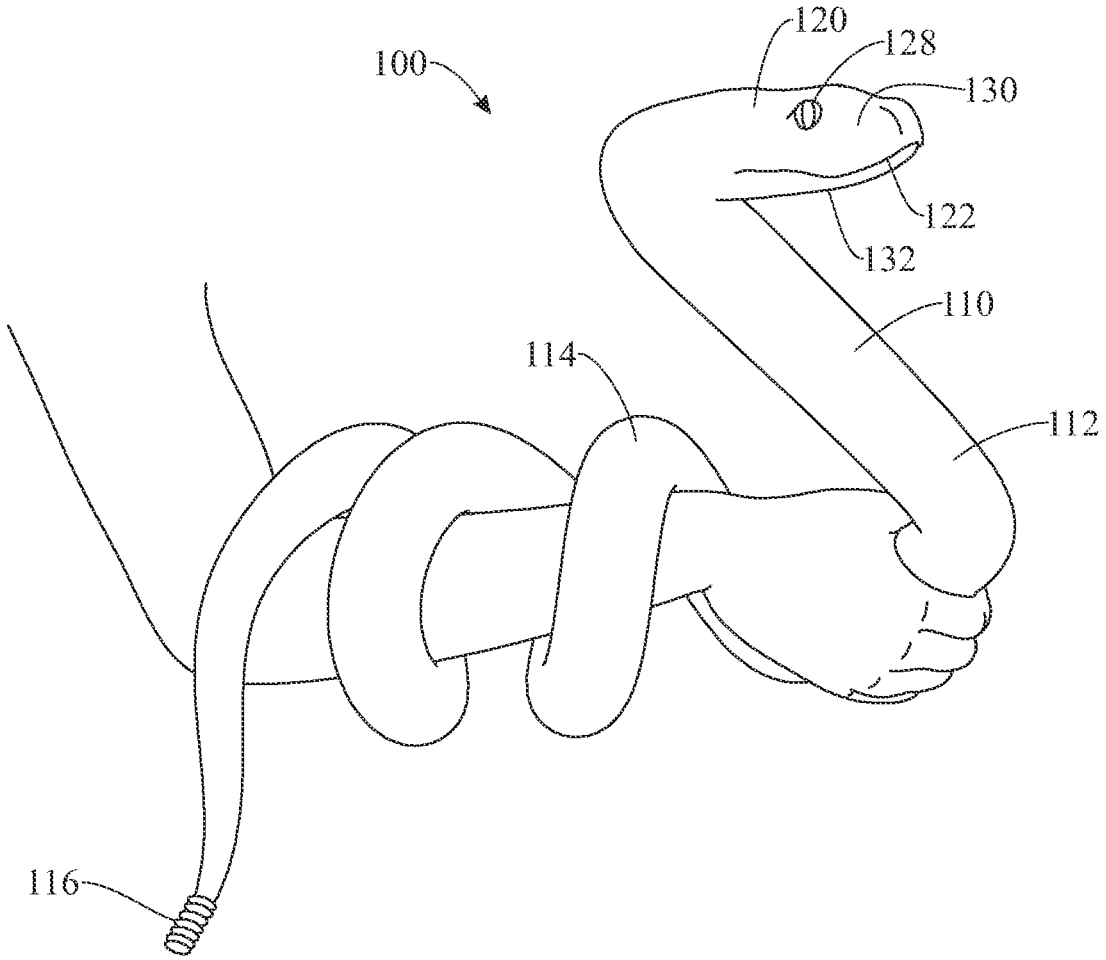
FIG. 1 presents a front view of a toy snake in accordance with a first illustrative embodiment of the present invention, the toy snake wrapped around the arm and hand of a user and shown in a rearward configuration.

Referring initially to FIG. 1, a formable, deformable or shapeable snake accessory or toy snake 100 in accordance with a first embodiment of the invention is shown, and is referred to generally hereinafter as toy snake 100. The toy snake 100 includes a body 110 and a head 120 arranged at and extending from a front end of the body 110. The body 110 may be divided into a front section, throat or neck (hereinafter referred to generically as front section 112), a central section 114 extending from the front section 112, and a tail 116 extending from the central section 114. The head 120, which extends from the front section 112 of the body 110, includes a mouth 122, and may include one or more fangs 124 (FIG. 2), a tongue 126 (FIG. 4), one or more eyes 128, and/or other features which may imitate those of a real snake and/or provide aesthetical effects, for instance and without limitation. The mouth 122 may be defined by a top portion 130 of the head 120 and a jaw or bottom portion 132 of the head 120, wherein the bottom portion 132 is movable (e.g., pivotable) relative to the top portion 130 between closed and open positions, as will be described in greater detail hereinafter. In turn, the tail 116 extends from a rear end of the central section 114 of the body 110. The body 110 and head 120 may be hollow and flexible, allowing the toy snake 100 to deform and move into multiple different configurations, such as a configuration in which the body 110 is wrapped around a person's arm, as shown in FIG. 1. For instance and without limitation, the body 110 and head 120 may be made of fabric, plastic, flexibly-interconnected metal links or parts, and/or other materials or combinations thereof which allow the toy snake 100 to deform and change shape.

Figure 2:
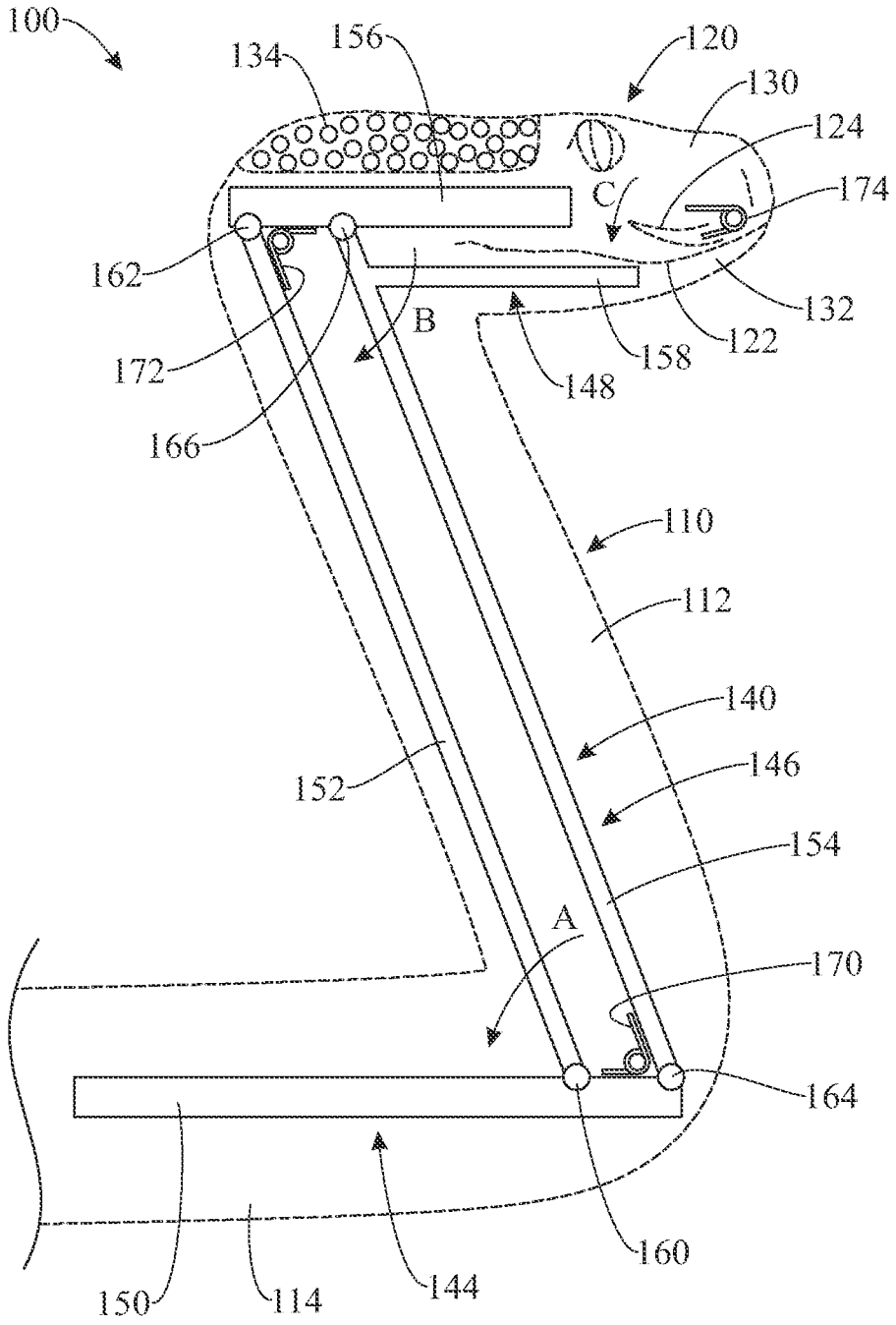
FIG. 2 presents an enlarged, side elevation view of the front of the toy snake in the rearward configuration of FIG. 1.

The illustration of FIG. 2 shows an enlarged, schematic side view of the head 120, the front section 112 of the body 110, and a front area of the central section 114 of the body 110, the view revealing functional components of the invention housed within the body 110 and head 120. As shown, the toy snake 100 comprises an internal, movable or deformable structure; in the present embodiment, the internal structure is an articulated structure 140 comprising a first structure subassembly 144, a second structure subassembly 146, and a head or third structure subassembly 148. The first structure subassembly 144 may include a first elongated member or segment 150, arranged generally within the front area of the central section 114 of the body 110. In turn, the second structure subassembly 146 may include a first elongated member or segment 152 and a second elongated member or segment 154, housed within the front section 112 of the body 110. As shown, the second segment 154 may be arranged in front of the first segment 152, The first and second segments 152 and 154 may be arranged in a spaced-apart relationship. Furthermore, as shown, the first and second segments 152 and 154 may be parallel to one another. The third structure subassembly 148 may include a first elongated member or segment 156 and a second elongated member or segment 158, housed within the head 120. As shown, the first segment 156 may be arranged above the second segment 158. The first and second segments 156 and 158 may be arranged in a spaced-apart relationship. Furthermore, as shown, the first and second segments 156 and 158 may be parallel to one another.

With continued reference to FIG. 2, the first segment 152 of the second structure subassembly 146 is pivotably connected to the first segment 150 of the first structure subassembly 144 and to the first segment 156 of the third structure subassembly 148 by first and second articulated connections 160 and 162, respectively. In turn, the second segment 154 of the second structure subassembly 146 is pivotably connected to the first segment 150 of the first structure subassembly 144 and to the first segment 156 of the third structure subassembly 148 by third and fourth articulated connections 164 and 166, respectively. The second segment 158 of the third structure subassembly 148 is rigidly (non-pivotably) attached to, or integrally-formed with, the second segment 154 of the second structure subassembly 146, The articulated connections 160, 162, 164, 166 form an articulated parallelogram allowing the third structure subassembly 148 to move frontward and rearward relative to the first structure subassembly 144 for purposes that will be hereinafter described.

A first spring 170 is connected to the first segment 150 and second segment 154 such that the articulated connections 160, 164 are spring-biased to pivot the second structure subassembly 146 rearwards, towards the first structure subassembly 144, as indicated by arrow A. A second spring 172 is connected to the first segment 152 and first segment 156 such that the articulated connections 162, 166 are spring-biased to pivot the third structure subassembly 148 downwards, towards the second structure subassembly 146, as indicated by arrow B. A third spring 174 is connected to the top portion 130 of the head 120 and to the fangs 124 such that the fangs 124 are spring-biased to pivot downward towards the bottom portion 132 of the head 120, as indicated by arrow C.

As further shown in FIG. 2, the head 120 may include one or more weights 134 for purposes that will be hereinafter described. The one or more weights 134 are preferably arranged inside the head 120, although alternative embodiments are contemplated. The one or more weights 134 may include a plurality of beads, seeds, small solid pieces, or other relatively small bodies which may provide a relatively pleasant tactile impression in addition to increasing the weight of the head 120.

In the absence of external forces counteracting the spring-bias provided by first and second springs 170 and 172, the toy snake 100 remains in a rearward configuration shown in FIG. 2. In this rearward configuration, the second structure subassembly 146 is pivoted towards the first structure subassembly 144, and the third structure subassembly 148 is pivoted towards the second structure subassembly 146. Also in this rearward configuration, the second segment 158 of the third structure subassembly 148 (associated to the jaw or bottom portion of the head 120) is pivoted towards the first segment 156 of the third structure subassembly 148 (associated to the top portion 130 of the head 120); because of this, the jaw or bottom portion 132 of the head 120 is pivoted against the top portion 130 of the head 120, and the mouth 122 is consequently closed. Furthermore, closing of the jaw or bottom portion 132 of the head 120 against the top portion 130 of the head 120 counteracts the spring-bias provided by the third spring 174 and maintains the fangs 124 in an elevated position, as shown, in which the fangs 124 are housed inside the mouth 122 (i.e. inside the head 120).

Figure 3:
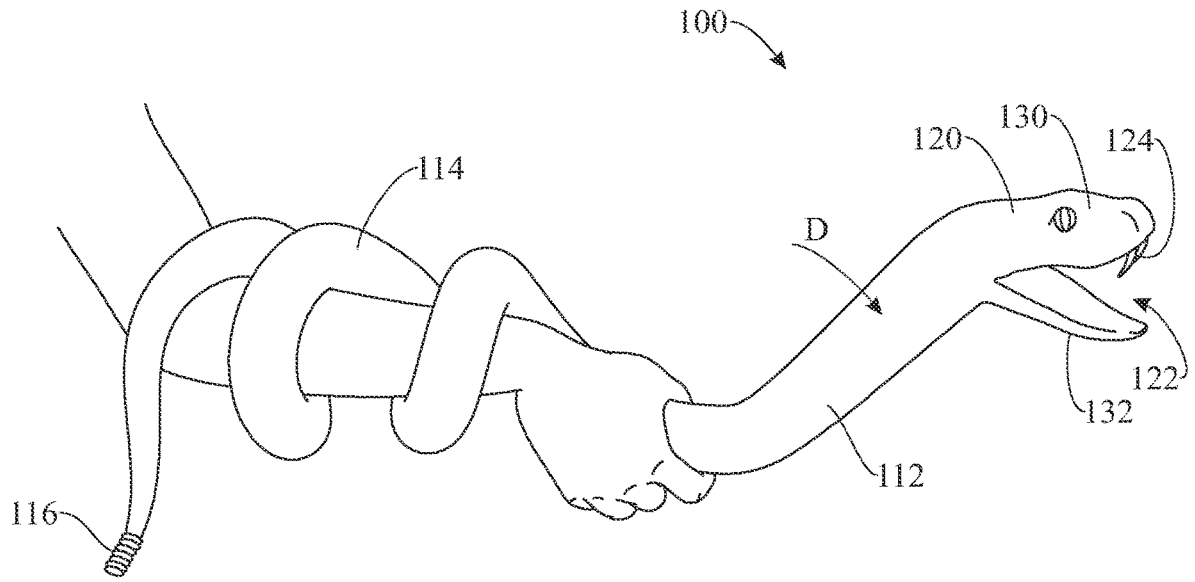
FIG. 3 presents a front view of the toy snake of FIG. 1, moved to a frontward or thrusted configuration.
Figure 4:
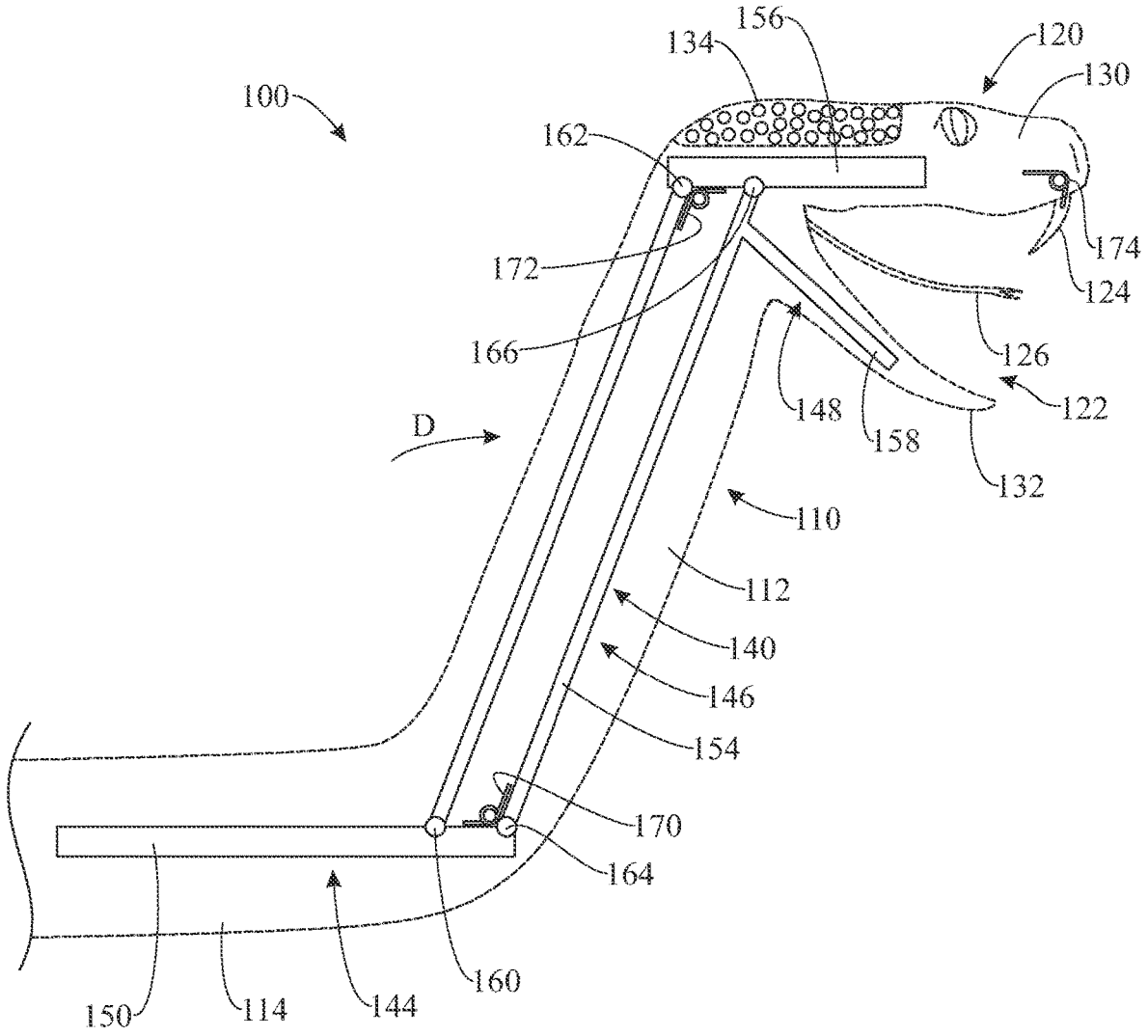
FIG. 4 presents an enlarged, side elevation view of the front of the toy snake in the frontward configuration of FIG. 3.

The toy snake 100 of the present disclosure is further configured to adopt a frontward or forward-thrusted configuration shown in FIGS. 3 and 4, responsively to external operation of the toy snake 100 in various ways. For example, as described heretofore, the user may have wrapped the snake body 110 around his or her arm, and may optionally grasp the central section 114 of the body 110 corresponding to (i.e. housing) the first structure subassembly 144 of the articulated structure 140. The user may then exert a forward and then rearward acceleration on the central section 114, similar to the swinging of a whip. Swinging the toy snake 100 similarly to a whip while grasping the area of the first structure subassembly 144 causes the weights 134, which are substantially spaced apart from the user's hand, to produce a sufficient moment or torque which overcomes the spring-bias of the springs 170, 172, 174 and 176 and causes the third structure subassembly 148 to move forward and pull on the second structure subassembly 146 about the second and fourth articulated connections 162 and 166, causing the second structure subassembly 146 to pivot forward relative to the first structure subassembly 144 about the first and third articulated connections 160 and 164. Forward pivoting of the second structure subassembly 146 relative to the first structure subassembly 144 produces the effect that the neck or front section 112 of the body 110 of the toy snake 100 is thrust forward, as indicated by arrow D in FIGS. 3 and 4, similarly to a real snake attacking. Furthermore, forward movement of the third structure subassembly 148 (i.e. upward pivoting of the third structure subassembly 148 relative to the second structure subassembly 146) causes the first and second segments 158 and 158 of the third structure subassembly 148 to pivot away from one another and the mouth 122 to open, which in turn frees the fangs 124 to extend outward by the action of the third spring 174, as shown in FIGS. 3 and 4, imitating a real snake striking motion. Furthermore, when the mouth 122 opens, the tongue 126 may extend outward and oscillate due to varying forces thereon (e.g., gravity, forces caused by the user swinging the toy snake 100). Accordingly, the tongue 126, given the articulated structure 140, can make a striking and rattling motion when the mouth 122 is in the open position. Furthermore, the tongue 126 may be configured to sufficiently oscillate such that it impacts other sections of the head 120 (e.g., the top portion 130, the bottom portion 132, the second segment 158) and thereby produces short, repetitive, impact sounds, which may imitate a real life snake rattling sound.

When the user ceases to swing the toy snake 100, the spring-biased actuator 170 returns the toy snake 100 to the rearward configuration of FIG. 2, shutting the snake's mouth 122 and retracting the fangs 124 inside the mouth 122.

The user may also exert several forward and rearward swinging motions in sequence, which would cause a repetitive movement between the configuration of FIGS. 1 and 2, and the configuration of FIGS. 3 and 4, in which the body 110 will thrust forward and the mouth 122 will go from a closed position to an open position intermittently or multiple times. This repetitive sequence may further mimic a real snake attacking behavior.

Figure 5:
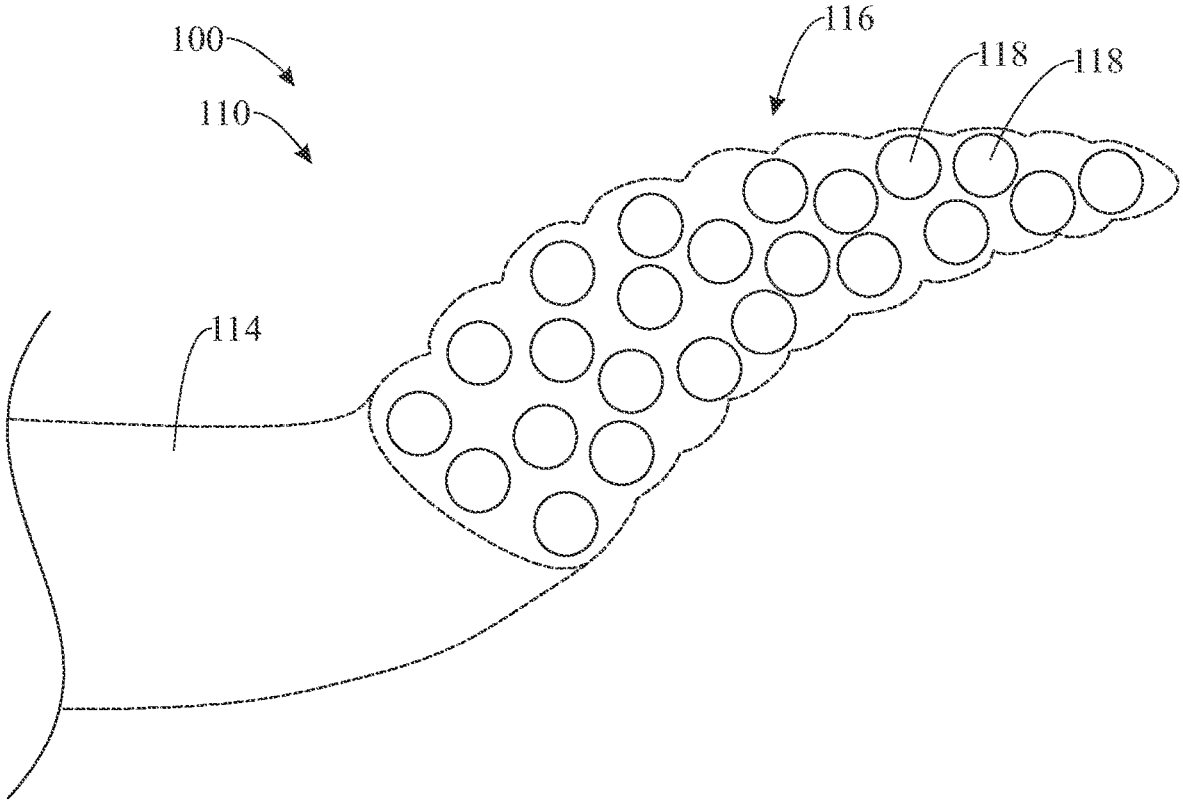
FIG. 5 presents a side view of the tail of the toy snake of FIG. 1.

The illustration of FIG. 5 shows an enlarged view of the tail 116 of the toy snake 100. As shown, in some embodiments, the tail 116 may include one or more tail weights 118, such as a plurality of beads, seeds, small solid pieces, or other relatively small bodies which may provide a relatively pleasant tactile impression in addition to increasing the weight of the tail 116. When playing with or otherwise using the toy snake 100, the person can shake the tail 116 of the toy snake 100, such as by shaking the central section 114 of the body 110 and thereby causing the tail 116 to shake relative to the central section 114. The one or more tail weights 118 contribute to increase the shaking effect on the tail 116. Moreover, the bending and elastic properties of the toy snake 100 and the articulated structure 140 of the toy snake 100 can enable force applied to the tail 116 to also be applied to the body 110 and the head 120 of the toy snake 100.

Figure 6:
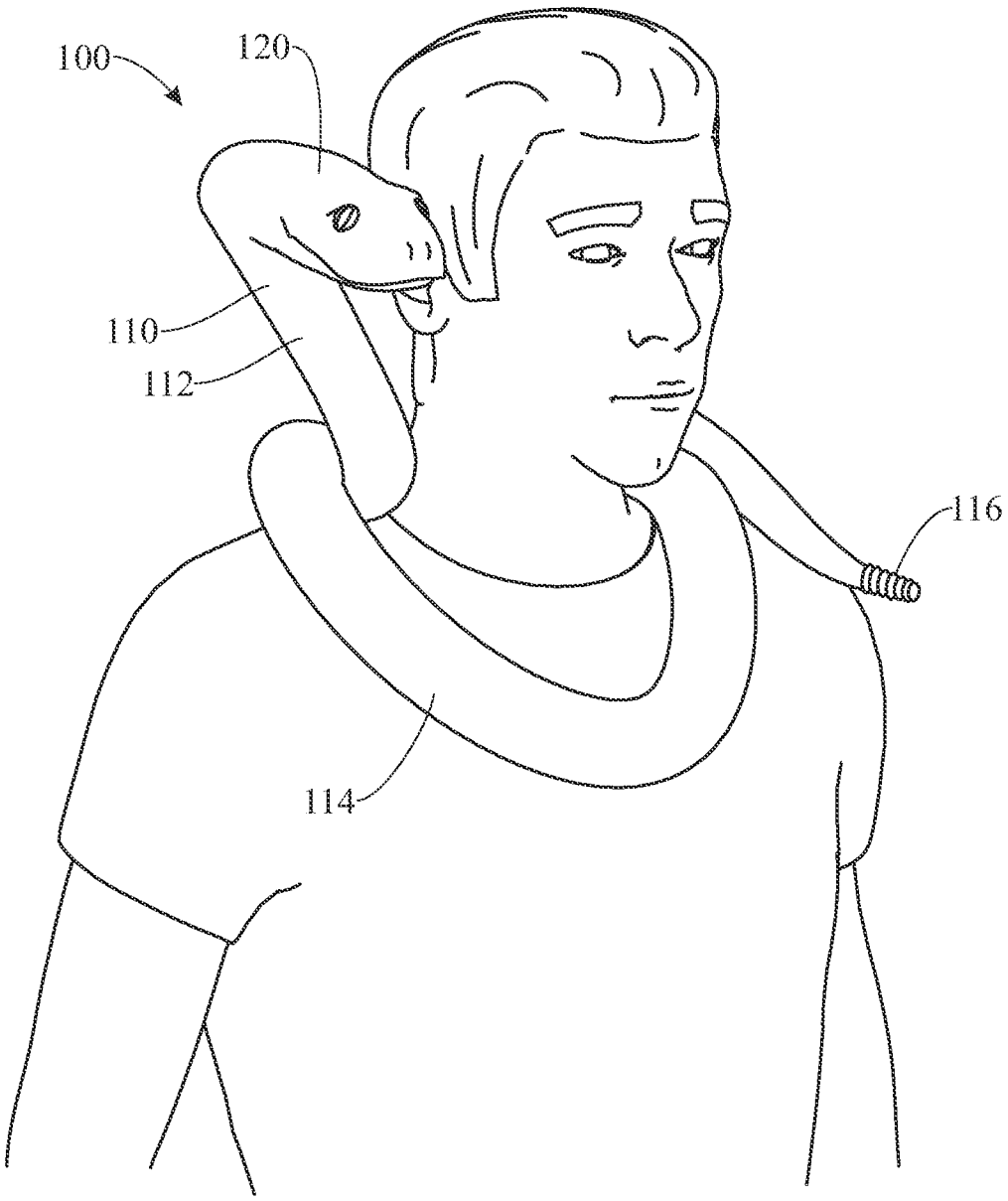
FIG. 6 presents another front view of the toy snake of FIG. 1, wrapped around the neck and shoulder of user in accordance with second illustrative method of operation of the toy, snake.

In another illustrative method of operation of the toy snake 100 of the present disclosure, the toy snake 100 can be wrapped around the neck or other body parts of the user. For instance, the illustration of FIG. 6 shows the toy snake 100 wrapped around the neck of a user. In these alternative positions, the user may also swing and thrust the toy snake 100 as described heretofore, by adequately moving his or her body in a forward and rearward swinging movement which enables the weights 134 in the head 120 to pull the head 120 and front section 112 of the body 110 to the forward configuration of FIGS. 3 and 4. In another example, the person can proceed to walk forward continuously, and the forward and rearward body motion of the user may cause the toy snake 100 to repetitively thrust forward and retract rearward. In yet another example of operation, the person may decide to shake the toy snake 100 as the toy snake 100 rests on his/her neck and shoulders. As the toy snake 100 rests on the neck of the person, the user may also stand in place and shake or thrust the toy snake 100 forward by shaking his/her neck and shoulders and/or roll his/her neck and shoulders, or by grasping and forward-rearward swinging the toy snake 100 as described with reference to FIGS. 3 and 4. The shaking motion from the user can cause the toy snake 100 to thrust forward.

Figure 7:
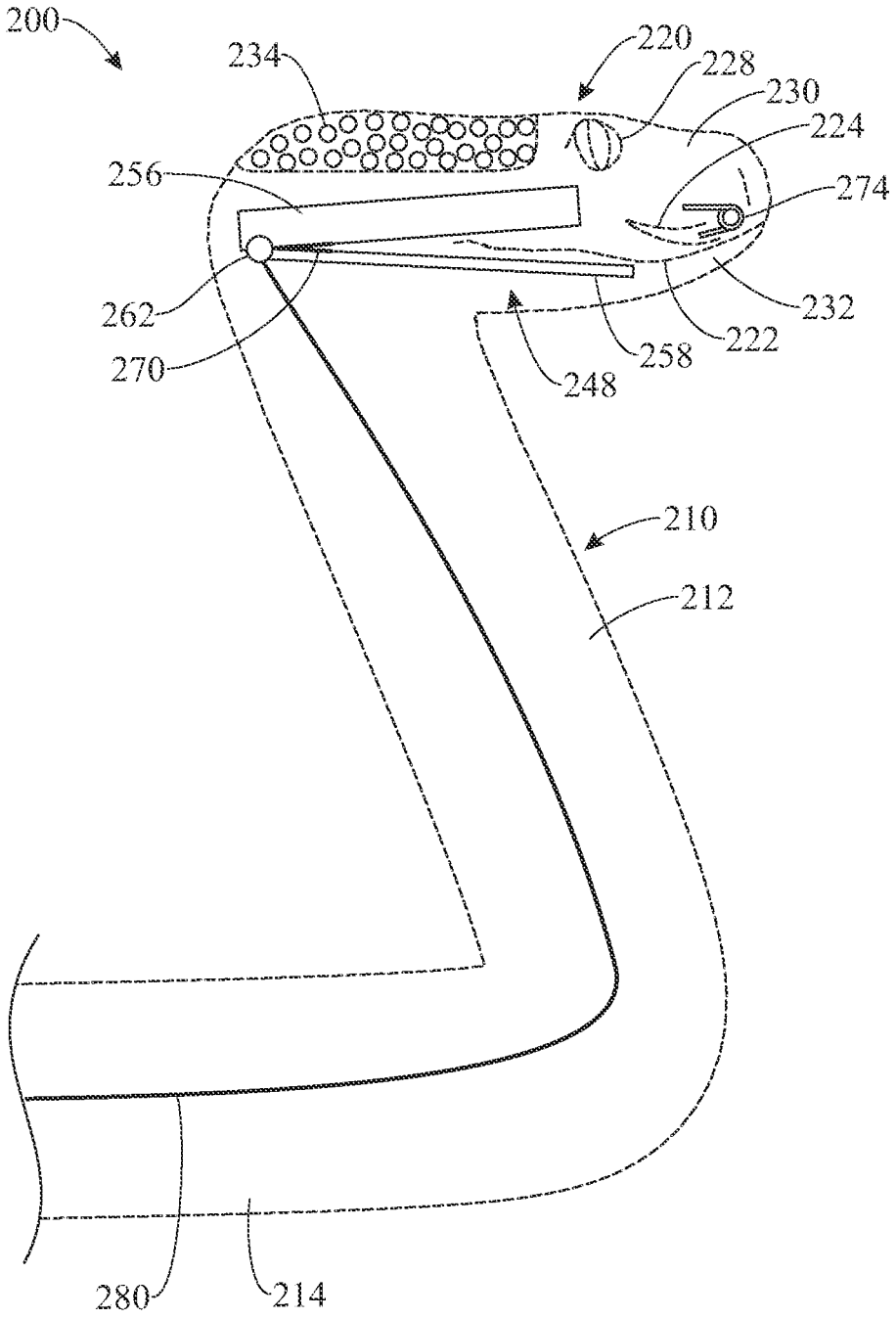
FIG. 7 presents a side elevation view of the front of a toy snake in accordance with a second illustrative embodiment of the present invention, the toy snake shown in a rearward configuration.
Figure 8:
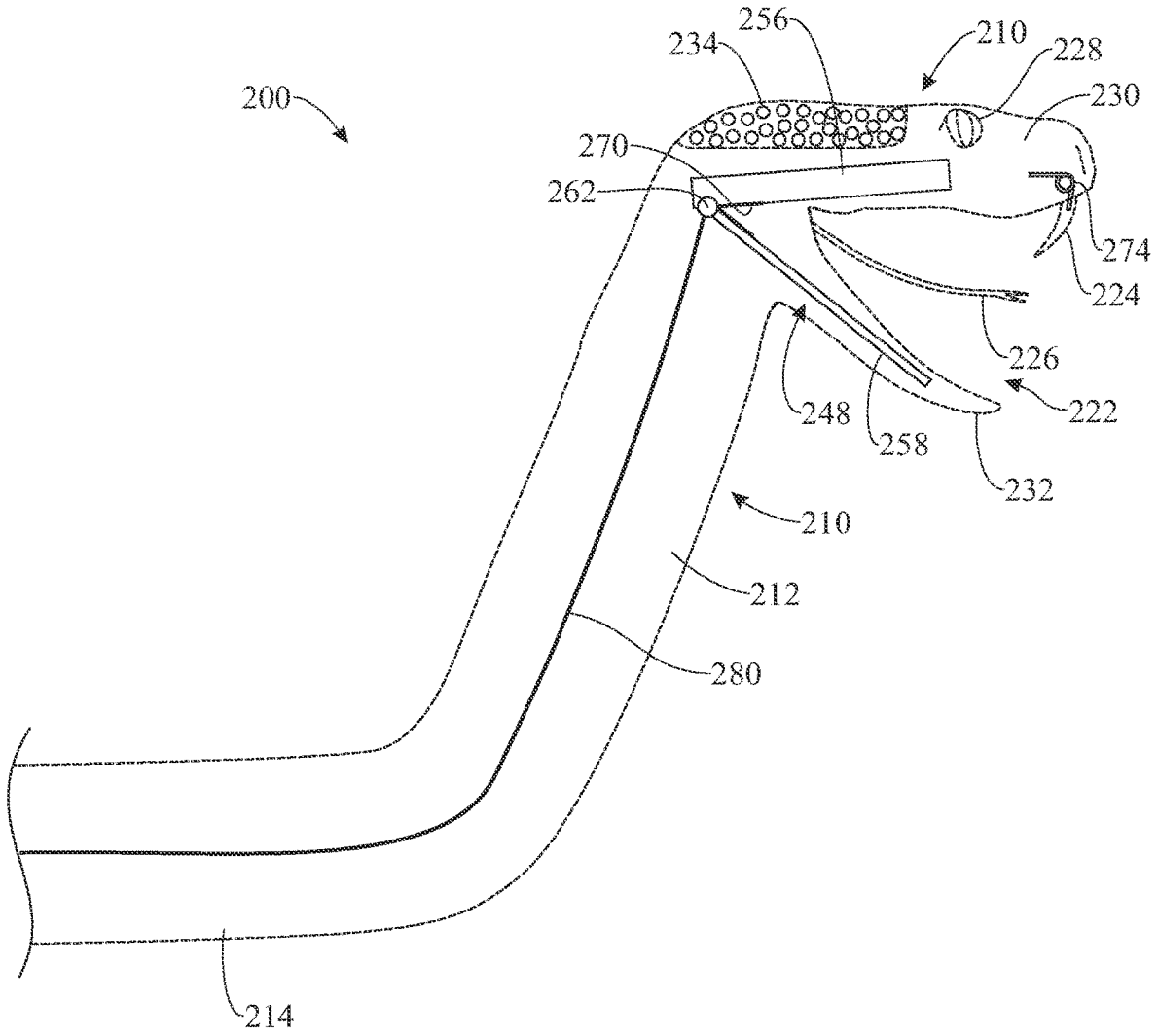
FIG. 8 presents a side elevation view of the toy snake of FIG. 7, shown in a frontward or thrusted configuration.

The illustrations of FIGS. 7 and 8 show a snake accessory or toy snake 200 in accordance with a second illustrative embodiment of the invention. Similarly to the previous embodiment, the toy snake 200 of the present embodiment includes a body 210 and a head 220 arranged at and extending from a front end of the body 210. The body 210 may be divided into a front section, throat or neck (hereinafter referred to generically as front section 212), a central section 214 extending from the front section 212, and a tail (not shown) extending from a rear end of the central section 214. The tail may include features such as those described heretofore with reference to tail 116. The head 220 includes a mouth 222, and may include one or more fangs 224, a tongue 226, one or more eyes 228, and/or other features, as described heretofore with reference to the first embodiment. The mouth 222 may be defined by a top portion 230 and a jaw or bottom portion 232 of the head 220, wherein the bottom portion 232 is movable (e.g., pivotable) relative to the top portion 230 between closed and open positions. Similarly to the previous embodiment, the body 210 and head 220 may be hollow and flexible, allowing the toy snake 200 to deform and move into multiple different configurations, such as a configuration in which the body 210 is wrapped around a person's arm, similarly to FIGS. 1 and 3. For instance and without limitation, the body 210 and head 220 may be made of fabric, plastic, flexibly-interconnected metal links or parts, and/or other materials or combinations thereof which allow the toy snake 200 to deform and change shape.

Similarly to the previous embodiment, the toy snake 200 comprises an internal, movable or deformable structure that participates in deformation of the body 210 of the toy snake 200. In the present embodiment, this internal structure includes a deformable wire 280. In some embodiments, the deformable wire 280 may be elastically deformable such that the wire tends to recover an original shape (e.g., a rearward position shown in FIG. 7) in the event that the wire is deformed (e.g., to a forward or thrusted position as shown in FIG. 8). In other embodiments, the wire may be plastically deformable, and capable of retaining either one of the rearward shape (FIG. 7) or the forward shape (FIG. 8).

As further shown in the figures, the internal, deformable structure further includes a head structure subassembly 248 housed within the head 220 and connected to the deformable wire 280. The head structure subassembly 248 includes a first elongated member or segment 256 and a second elongated member or segment 258, which may be pivotably connected to one another by an articulated connection 262. The first segment 256 may be located above the second segment 258, as shown. Similarly to the previous embodiment, the first and second segments 256 and 258 are associated to the top and bottom portions 230 and 232 of the head 220, respectively, such that the top portion 230 moves jointly with the first segment 256 and the bottom portion 232 moves jointly with the second segment 258. In some embodiments, the deformable wire 280 may be attached to the articulated connection 262, as shown. In some embodiments, the deformable wire 280 and the second segment 258 may be interconnected such that the angle formed therebetween remains relatively constant during operation of the toy snake 200 and/or such that the deformable wire 280 and the second segment 258 pivot jointly relative to the articulated connection 262. A first spring 270 may be connected between the first segment 256 and the second segment 258, such as to spring-bias the second segment 258 towards the first segment 256. In turn, similarly to the previous embodiment, a second spring 274 may be connected to the top portion 230 of the head 220 and to the fangs 224 such that the fangs 224 are spring-biased to pivot downward towards the bottom portion 232 of the head 220. Also similarly to the previous embodiment, the head 220 and/or other areas of the toy snake 200 may include one or more weights 234.

As shown in FIG. 7, the toy snake 200 may adopt a rearward configuration, in which the deformable wire 280 is flexed rearward such that the front section 212 of the body 210 is bent or pivoted rearward relative to the central section 214 of the body 210. Also in this rearward configuration, the second segment 258 of the head structure subassembly 248 (associated to the jaw or bottom portion of the head 220) is pivoted towards the first segment 256 of the head structure subassembly 248 (associated to the top portion 230 of the head 220); because of this, the jaw or bottom portion 232 of the head 220 is pivoted against the top portion 230 of the head 220, and the mouth 222 is consequently closed. Furthermore, closing of the jaw or bottom portion 232 of the head 220 against the top portion 230 of the head 220 counteracts the spring-bias provided by the second spring 274 and maintains the fangs 224 in an elevated position, as shown, in which the fangs 224 are housed inside the mouth 222 (i.e. inside the head 220).

As shown in HQ. 8, the toy snake 200 may adopt a frontward or thrusted configuration, responsively to external operation of the toy snake 200 in various ways. For example, as described with reference to the previous embodiment, the user may have wrapped the snake body 210 around his or her arm, and may grasp the central section 214 of the body 210. The user may then exert a forward and then rearward acceleration (i.e. a pair of forward and rearward forces) on the central section 214, similar to the swinging of a whip, causing the front section 212 of the body 210 to pivot forward relative to the central section 214, thereby causing the head 220 and the head structure subassembly 248 to thrust forward, similarly to a real snake attacking. Furthermore, forward movement of the head structure subassembly 248 causes the deformable wire to pivot rearward about the articulated connection 262, which may cause the second segment 258 of the mouth 222 to also pivot rearward relative to the articulated connection 262 and counteract the first spring 270, allowing the mouth 222 to open, which in turn enables the fangs 224 to extend outward by action of the second spring 274, as shown in FIG. 8, imitating a real snake striking motion. When the mouth 222 opens, the tongue 226 may extend outward and oscillate due to varying forces thereon (e.g., gravity, forces caused by the user swinging the toy snake 200). Accordingly, the tongue 226 can make a striking and rattling motion when the mouth 222 is in the open position. Furthermore, the tongue 226 may be configured to sufficiently oscillate such that it impacts other sections of the head 220 (e.g., the top portion 230, the bottom portion 232, the second segment 258) and thereby produces short, repetitive, impact sounds, which may imitate a real life snake raffling sound.

In embodiments in which the deformable wire 280 is elastically deformable, when the user ceases to swing the toy snake 200, the deformable wire 280 returns the toy snake 200 to the rearward configuration of FIG. 7, shutting the snake's mouth 222 and retracting the fangs 224 inside the mouth 222, In embodiments in which the deformable wire 280 is plastically, deformable, the user may instead manually force the toy snake 200 to the rearward configuration of FIG. 7, such as by exerting a forward and then rearward pair of forces, inversely to the forward-thrusting pair of forces described heretofore.

The user may also exert several forward and rearward swinging motions in sequence, which would cause a repetitive movement between the configuration of FIGS. 7 and 8, in which the body 210 will thrust forward and the mouth 222 will go from a closed position to an open position intermittently or multiple times. This repetitive sequence may further mimic a real snake attacking behavior.

Alternative embodiments in which additional ways of shaking or thrusting the formable, deformable or shapeable toy snake 100, 200 forward may be contemplated. For example, the toy snake 100, 200 may have springing and bouncing properties that can allow the toy snake 100, 200 to rattle and thrust forward when the person squeezes the body 110, 210 of the toy snake 100, 200. Alternatively or additionally, the person may wear the toy snake 100, 200 on other parts of the body not described above which can thrust the toy snake 100, 200 forward or cause the toy snake 100, 200 to shake. For example, the illustrative use described with reference to FIG. 6 and toy snake 100 may be applicable to toy snake 200. The person may also cause the toy snake to shake or thrust forward by applying force to other parts of the toy snake 100, 200 not described above. In addition, the person may wish to play with the toy snake while sitting or lying down as users may wish to do with one or more of their toy devices.

Since many modifications, variations, and changes in detail can be made to the described preferred embodiments of the invention, it is intended that all matters in the foregoing description and shown in the accompanying drawings be interpreted as illustrative and not in a limiting sense, Thus, the scope of the invention should be determined by the appended claims and their legal equivalents.

What is claimed is:

1. A deformable snake accessory comprising:

a head, comprising a top portion and a bottom portion, wherein the top and bottom portions define a mouth and are movable relative to one another to adjust the mouth between an open position and a closed position; and a deformable body connected to the head, the body comprising a front section carrying the head and a central section extending rearward from the front section; Wherein the mouth is movable to the open position by applying a forward force followed by a rearward force on the central section of the body, such that the front section of the body and the bottom portion of the head are thrust forward relative to the central section of the body and the top portion of the head is moved away from the central section of the body and the bottom portion of the head; wherein the deformable snake accessory further comprises at least one fang movably carried by the top portion of the head, the at least one fang configured to move from a first position, in which the at least one fang is moved towards the top portion and concealed within the mouth in the closed position, to a second position, in which the at least one fang is moved away from the top portion and visible within the mouth in the open position.

2. The deformable snake accessory of claim 1, wherein the head comprises one or more weights.

3. The deformable snake accessory of claim 1, wherein the top portion of the head comprises one or more weights.

4. The deformable snake accessory of claim 3, wherein the one or more weights are located at a rear area of the top portion of the head.

5. The deformable snake accessory of claim 1, wherein the mouth is movable to the closed position by a movement of the front section of the body and the bottom portion of the head towards the central section of the body and a movement of the top portion of the head towards the central section of the body and the bottom portion of the head.

6. The deformable snake accessory of claim 5, wherein the body is elastically deformable such that the front section of the body is biased to move towards the central section of the body.

7. The deformable snake accessory of claim 1, wherein the top and bottom portions of the head are pivotable relative to one another.

8. The deformable snake accessory of claim 1, wherein the bottom portion of the head is jointly movable with the front section of the body.

9. The deformable snake accessory of claim 1, wherein the top and bottom portions of the head are spring-biased towards one another to adjust the mouth to the closed position.

10. The deformable snake accessory of claim 1, wherein the body comprises an internal deformable structure housed inside the central and front sections of the body, and further wherein the head comprises internal, first and second elongate members housed inside the top and bottom portions of the head, respectively, the first and second elongate members movably connected to the internal deformable structure.

11. The deformable snake accessory of claim 10, wherein the deformable structure is elastically deformable.

12. The deformable snake accessory of claim 10, wherein the first elongate member is articulately connected to the deformable structure.

13. The deformable snake accessory of claim 12, wherein the deformable structure is articulately connected to the first elongate member by at least one pivotable connection.

14. The deformable snake accessory of claim 10, wherein the second elongate member is carried by and movable jointly with the deformable structure.

15. The deformable snake accessory of claim 1, wherein the at least one fang is movable to the second position upon a movement of the mouth to the open position.

16. The deformable snake accessory of claim 15, wherein the at least one fang is spring-biased towards the second position and automatically movable to the second position upon a movement of the mouth to the open position.

17. The deformable snake accessory of claim 1, further comprising a tongue portion carried by the head and configured to freely oscillate within the mouth when the mouth is arranged in the open position.

* * * * *